US008245869B2

(12) United States Patent
Yasumuro et al.

(10) Patent No.: US 8,245,869 B2
(45) Date of Patent: Aug. 21, 2012

(54) PACKAGING CONTAINER FOR MICROWAVE OVEN AND PROCESS FOR MANUFACTURING THE SAME

(75) Inventors: Hisakazu Yasumuro, Yokohama (JP); Shuuichi Nonaka, Yokohama (JP); Osamu Gotou, Yokohama (JP); Shie Nishimoto, Yokohama (JP); Keizou Kanzaki, Yokohama (JP); Kikuo Matsuoka, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 818 days.

(21) Appl. No.: 12/296,176

(22) PCT Filed: Sep. 29, 2006

(86) PCT No.: PCT/JP2006/319421

§ 371 (c)(1),
(2), (4) Date: Dec. 30, 2008

(87) PCT Pub. No.: WO2007/113930

PCT Pub. Date: Oct. 11, 2007

(65) Prior Publication Data

US 2009/0110784 A1 Apr. 30, 2009

(30) Foreign Application Priority Data

Apr. 4, 2006 (JP) ..... 2006-102938

(51) Int. Cl.
*B65D 81/34* (2006.01)
*B65D 51/16* (2006.01)
*B28B 1/48* (2006.01)

(52) U.S. Cl. ..... 220/359.4; 220/202; 220/203.01; 220/203.16; 220/203.29; 220/360; 220/364; 220/366.1; 426/107; 426/113; 264/154

(58) Field of Classification Search ..... 220/202, 220/203.01, 203.16, 203.29, 359.4, 360, 220/364, 366.1; 426/107, 110, 113; 264/154
See application file for complete search history.

(56) References Cited

U.S. PATENT DOCUMENTS

| | | | | |
|---|---|---|---|---|
| 3,937,396 | A | 2/1976 | Schneider | |
| 5,039,001 | A | 8/1991 | Kinigakis et al. | |
| 5,316,603 | A * | 5/1994 | Akazawa et al. | 156/69 |
| 5,587,192 | A | 12/1996 | Beizermann | |
| 6,847,022 | B2 * | 1/2005 | Hopkins, Sr. | 219/735 |

FOREIGN PATENT DOCUMENTS

| | | | |
|---|---|---|---|
| CN | 1420066 | A | 5/2003 |
| CN | 1278909 | C | 10/2006 |
| EP | 0 597 741 | A1 | 5/1994 |

(Continued)

*Primary Examiner* — Anthony Stashick
*Assistant Examiner* — Madison L Wright
(74) *Attorney, Agent, or Firm* — Sughrue Mion, PLLC

(57) ABSTRACT

Provided are a packaging container for a microwave oven that excels in the sealing performance between a container body and lid, and that at heating/cooking by a microwave oven, maintains the internal pressure of the container for a given period of time to thereby enhance the taste of contents through steaming effect, and that thereafter, can spontaneously open with certainty from a steam releasing seal part; and an efficient process for manufacturing the packaging container. In the packaging container for microwave oven having a lid heat-sealed to the periphery of a flange part of container body made of a synthetic resin so as to attain hermetic sealing, at least one steam releasing seal part with a weakened part is disposed inside the peripheral seal part of the flange part at a position separate from the peripheral seal part.

4 Claims, 7 Drawing Sheets

FOREIGN PATENT DOCUMENTS

| | | | |
|---|---|---|---|
| JP | 62-235080 | A | 10/1987 |
| JP | 1-107585 | | 7/1989 |
| JP | 1989-107585 | | 7/1989 |
| JP | 03-60239 | | 6/1991 |
| JP | 1991-60239 | | 6/1991 |
| JP | 3056026 | U | 11/1998 |
| JP | 11-171261 | A | 6/1999 |
| JP | 2000-62858 | A | 2/2000 |
| JP | 2002-337919 | A | 11/2002 |
| JP | 2003-221078 | A | 8/2003 |
| JP | 2005-178903 | A | 7/2005 |
| JP | 2005-187079 | A | 7/2005 |

* cited by examiner

PACKAGING CONTAINER FOR MICROWAVE OVEN AND PROCESS FOR MANUFACTURING THE SAME

TECHNICAL FIELD

The present invention relates to a packaging container for a microwave oven, which is used to contain sterile rice, retort food, frozen food, or the like to heat for cooking in the microwave oven, and to a process for manufacturing the packaging container.

BACKGROUND ART

Hitherto, there have been known various synthetic resin packaging containers for cooking by a microwave oven, which are sealed up after the packaging containers contain sterile cooked rice, retort food, and frozen food, or the like, and heated in the microwave oven to cook the contained products at the time of eating. However, when the packaging container is heated in the microwave oven, inside pressure of the packaging container is increased by steam and the like generated from the food contained therein, the packaging container explodes, and the food is scattered. As a result, the inside of the microwave oven becomes a mess, and harm such as a scald may be inflicted on the human body.

Therefore, before the above packaging container is heated for cooking in the microwave oven, the packaging container is partially unsealed or a hole is produced in the packaging container to discharge steam and the like, which are generated in the packaging container, to the outside thereof so as to prevent the explosion of the packaging container.

However, the above-mentioned method requires care to an ordinary consumer. Because steam generated from the food inside the packaging container by heating in the microwave oven is discharged to the outside of the packaging container immediately, the packaging container has a disadvantage in that the effect of heating and steaming the contents of the container by steam lowers, and the taste of the contents become worse.

To eliminate the disadvantage described above, various packaging containers for cooking by a microwave oven have been proposed, in which when a container made of a synthetic resin having a flange part is filled with food or the like, and a peripheral part of a lid is heat-sealed to the flange part, a projecting part that projects in an inside direction of the container is formed at the peripheral seal part.

These packaging containers are prevented from exploding by allowing the projecting part to spontaneously open due to the increase in an internal pressure in the container at heating/cooking by a microwave oven. (For example, see Patent Documents 1-3)

Patent Document 1: JP 62-235080 A
Patent Document 2: JP 11-171261 A
Patent Document 3: JP 2000-62858 A However, in the packaging containers for cooking by a microwave oven described in these Patent Documents, the peripheral seal part of the flange part and the lid projects in an inside direction of the container. Therefore, it is not easy to form the projecting part that spontaneously opens during heating on a practical level on the flange part with a limited space. More specifically, the projecting part may be displaced to impair the sealing performance of the peripheral seal part, or the projecting part may explode without spontaneously opening during heating. Further, there has been a problem in that the flange part needs to be configured with a large width, which increases the amount of materials constituting the container, resulting an increase in cost.

DISCLOSURE OF THE INVENTION

Problems to be Solved by the Invention

Therefore, an object of the present invention is to provide a packaging container for a microwave oven, which excels in the sealing performance between a container body and a lid; which, at heating/cooking by a microwave oven, maintains the internal pressure of the container for a given period of time, thereby enhancing the taste of contents through a steaming effect; and which thereafter can spontaneously open with certainty from a steam releasing seal part, and an efficient process for manufacturing the packaging container.

Means for Solving the Problems

The inventors of the present invention have found that the above-mentioned problems are solved by providing a steam releasing seal part having a weakened part inside a peripheral seal part of a flange part in a packaging container for a microwave oven, which is sealed when a lid is heat-sealed to the periphery of the flange part, at a position separate from the peripheral seal part, thereby achieving the present invention.

More specifically, the present invention adopts the following 1 to 9 constitutions.

1. A packaging container for a microwave oven which is hermetically sealed by heat-sealing a lid to a periphery of a flange part of a container body made of a synthetic resin, comprising at least one steam releasing seal part having a weakened part inside a peripheral seal part of the flange part at a position separated from the peripheral seal part.

2. A packaging container for a microwave oven according to the item 1, in which the steam releasing seal part provided in the flange part comprises an outer seal part, a buffer part adjacent to the outer seal part, and a weakened part made of a through-hole formed in the flange part of the buffer part.

3. A packaging container for a microwave oven according to the item 1 or 2, in which a through-hole is formed in the lid in the buffer part of the steam releasing seal part.

4. A packaging container for a microwave oven according to any one of the items 1 to 3, in which a container body made of a synthetic resin is a square container, and the steam releasing seal part is provided in a corner portion of the container.

5. A packaging container for a microwave oven according to any one of the items 1 to 4, in which a convex part is provided at a position corresponding to the outer seal part of the steam releasing seal part of the flange part, and the outer seal part of the steam releasing seal part is formed by heat-sealing the convex part to the lid.

6. A packaging container for a microwave oven according to any one of the items 1 to 5, in which a convex part is provided along an entire outer peripheral part of the flange part, and the lid is heat-sealed to the convex part to form a peripheral seal part.

7. A process for manufacturing the packaging container for a microwave oven according to the item 5 or 6 comprising:

forming a convex part and a through-hole as a weakened part both provided in a flange part simultaneously, when a packaging container body is manufactured by processing a plastic sheet.

8. A process for manufacturing the packaging container for a microwave oven according to item 5 or 6 comprising:

trimming a flange outer peripheral part from a plastic sheet and forming a convex part and a through-hole as a weakened part both provided in a flange part simultaneously, when a packaging container body is manufactured by processing the plastic sheet.

9. A process for manufacturing the packaging container for a microwave oven according to any one of the items 1 to 4 comprising:

trimming a flange outer peripheral part from a plastic sheet and forming a through-hole as a weakened part in a flange part simultaneously, when a packaging container body is manufactured by processing the plastic sheet.

Effects of the Invention

By adopting the above-mentioned constitutions, the present invention exhibits the following effects.

(1) The sealing performance between a packaging container body and a lid is satisfactory, and contents will not leak in the course of manufacturing, distribution, and the like.

(2) At heating/cooking by a microwave oven, the packaging container is maintained for a given period of time while the internal pressure therein is increased to some degree, and the cooking time of food contained in the packaging container is shortened through a steaming effect, whereby the taste of the food can be enhanced.

(3) When the internal pressure of the packaging container reaches a predetermined level or more, the packaging container spontaneously opens with certainty at a steam releasing seal part, whereby the container can be prevented from exploding or being deformed.

(4) Special steps and members are not required for manufacturing the packaging container, and the packaging container can be manufactured at a low cost, suppressing the use amount of materials constituting the packaging container.

(5) When the packaging container body is manufactured, trimming of a flange outer peripheral part of the container body from a sheet, formation of a through-hole as a weakened part, and formation of convex parts provided on the flange part (a convex part corresponding to an outer seal part of the steam releasing seal part and a convex part to be a heat-sealed part with respect to a lid to be provided along the entire outer peripheral part of the flange part) are performed simultaneously, whereby the displacement of the steam releasing seal part provided at the flange part is eliminated to prevent seal leakage. Consequently, the packaging container for a microwave oven can be obtained, in which the steam releasing seal part spontaneously opens stably at heating/cooking by a microwave oven.

DESCRIPTION OF SYMBOLS

Figure 1:
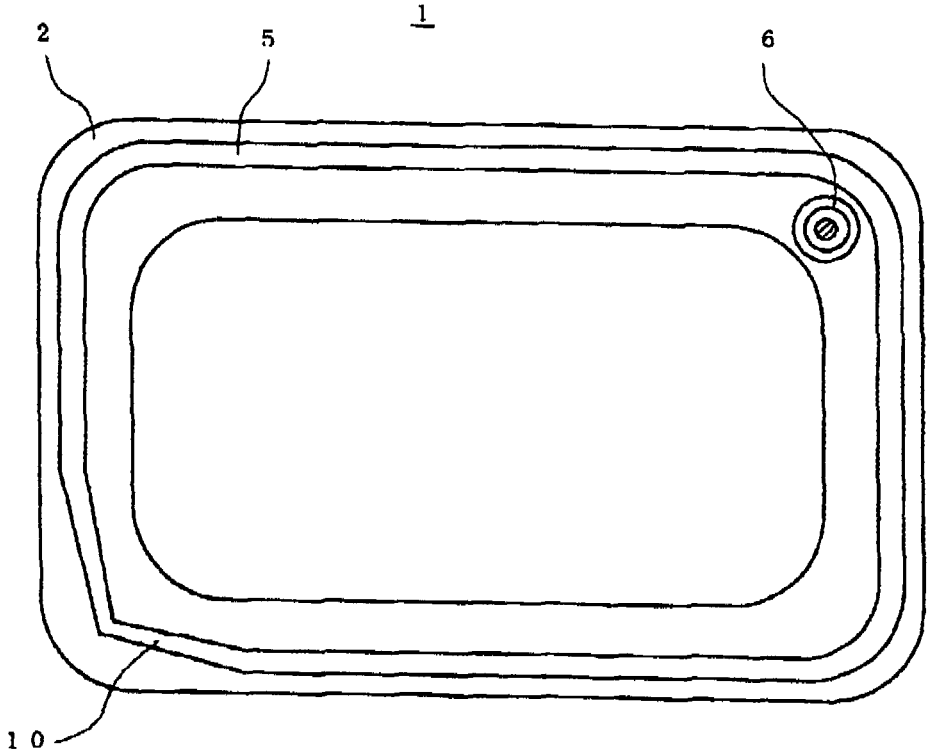
FIG. 1 A plan view showing an example of the packaging container for a microwave oven of the present invention.

1, 11, 21, 31, 41, 51, 61 packaging container for microwave oven
2 flange part
3 container body
4 lid
5 peripheral seal part
6 steam releasing seal part
7 outer seal part
8 buffer part
9 weakened part
10 sealed part for opening
15, 17 convex part
101, 201 apparatus
102, 202 rolled multi-layered sheet
103, 203 heater
104, 204 forming station
105, 205 plug
106, 206 die
207 punch
208 trimming apparatus

BEST MODE FOR CARRYING OUT THE INVENTION

As the material constituting the container body and lid of the package for cooking by a microwave oven of the present invention, a plastic material having heat sealability which is generally used for the manufacture of a packaging container is used. The plastic material is, for example, a single-layer film or sheet made of a thermoplastic resin having heat sealability, and a multi-layer film or sheet made of a thermoplastic resin having heat sealability and another thermoplastic resin.

Examples of the plastic material having heat sealability include olefin-based resins such as known low-density polyethylene, linear low-density polyethylene, medium-density polyethylene, high-density polyethylene, polypropylene, propylene-ethylene copolymer, ethylene-vinyl acetate copolymer and olefin resins graft-modified by an ethylene-based unsaturated carboxylic acid or anhydride thereof; polyamide and copolyamide resins having a relatively low melting point or a low softening point; polyester and copolyester resins; and polycarbonate resins.

Examples of the another plastic material to be laminated with the plastic material having heat sealability include thermoplastic resins having or not having heat sealability, various barrier films and oxygen absorbing resins.

Examples of such a thermoplastic resin include: polyolefins such as crystalline polypropylene, a crystalline propylene/ethylene copolymer, crystalline polybutene-1, crystalline poly4-methylpentene-1, low-, medium-, or high-density polyethylene, ethylene/vinyl acetate copolymer (EVA), EVA saponified product, ethylene/ethyl acrylate copolymer (EEA), and an ion crosslinked olefin copolymer (ionomer); aromatic vinyl copolymers such as polystyrene or styrene/butadiene copolymer; halogenated vinyl polymers such as polyvinyl chloride or vinylidene chloride resin; polyacrylic resins; nitrile polymers such as acrylonitrile/styrene copolymer or acrylonitrile/styrene/butadiene copolymer; polyesters such as polyethylene terephthalate and polytetramethylene terephthalate; polyamides such as 6-nylon, 12-nylon, and metaxylene diamine (MX) nylon; various polycarbonates; fluorine-based resins; and polyacetals such as polyoxymethylene. One kind of thermoplastic resin may be used alone, or two or more kinds thereof may be blended and used. Further, the thermoplastic resin may be used by mixing various additives.

All films made of a known thermoplastic resin having oxygen barrier properties may be used as the barrier films. Examples of the resin include ethylene-vinyl alcohol copolymers, polyamides, polyvinylidene chloride-based resins, polyvinyl alcohols and fluororesins. A resin not containing chlorine, which may not generate harmful gas, when the resin is burnt, is preferably used.

The particularly preferred oxygen barrier resin is copolymer saponified product obtained by saponifying ethylene-vinyl acetate copolymer having an ethylene content of 20 to 60 mol %, specifically 25 to 50 mol % to a saponification degree of 96 mol % or more, specifically 99 mol % or more.

Other preferred oxygen barrier resins include polyamides having 5 to 50 amido groups, specifically 6 to 20 amido groups based on 100 carbon atoms such as nylon 6, nylon 6, 6, nylon 6/6, 6 copolymer, metaxylylene adipamide (MX6), nylon 6, 10, nylon 11, nylon 12, and nylon 13.

Examples of other barrier films include: a silica vapor deposited polyester film, an alumina vapor deposited polyester film, a silica vapor deposited nylon film, an alumina vapor deposited nylon film, an alumina vapor deposited polypropylene film, a carbon vapor deposited polyester film, a carbon vapor deposited nylon film; a co-vapor deposited film prepared through co-vapor deposition of alumina and silica on a base film such as a polyester film or a nylon film; a co-extruded film such as a nylon 6/metaxylene diamine nylon co-extruded film or a propylene/ethylene-vinyl alcohol copolymer co-extruded film; an organic resin-coated film such as a polyvinyl alcohol-coated polypropylene film, a polyvinyl alcohol-coated polyester film, a polyvinyl alcohol-coated nylon film, a polyacrylic resin-coated polyester film, a polyacrylic resin-coated nylon film, a polyacrylic resin-coated polypropylene film, a polyglycolic acid resin-coated polyester film, a polyglycolic acid resin-coated nylon film, or a polyglycolic acid resin-coated polypropylene film; and a film prepared by coating a hybrid coating material formed of an organic resin material and an inorganic material on a base film such as a polyester film, a nylon film, or a polypropylene film.

One kind of barrier film may be used alone, or two or more kinds thereof may be used in combination.

A resin having an oxygen absorbable property may employ (1) a resin having oxygen absorbing property itself or (2) a resin composition containing an oxygen absorber in a thermoplastic resin having or not having oxygen absorbing property. The thermoplastic resin used for forming the oxygen absorbable resin composition (2) is not particularly limited, and a thermoplastic resin having oxygen barrier property or a thermoplastic resin having no oxygen barrier property may be used. Use of a resin having oxygen absorbing property or oxygen barrier property itself for the thermoplastic resin used for forming the resin composition (2) is preferred because intrusion of oxygen into the container may be effectively prevented by combination with an oxygen absorbing effect of the oxygen absorber.

An example of the resin having oxygen absorbing property itself is a resin utilizing an oxidation reaction of the resin. Examples of such a material include an oxidative organic material such as polybutadiene, polyisoprene, polypropylene, ethylene/carbon monoxide copolymer, or polyamides such as 6-nylon, 12-nylon, or metaxylene diamine (MX) nylon having organic acid salts each containing a transition metal such as cobalt, rhodium, or copper as an oxidation catalyst or a photosensitizer such as benzophenone, acetophenone, or chloroketones added. In the case where the oxygen absorbing material is used, high energy rays such as UV rays or electron rays may be emitted, to thereby develop further oxygen absorbing effects.

Any oxygen absorbers conventionally used for such applications can be used as an oxygen absorber to be mixed into a thermoplastic resin. A preferred oxygen absorber is generally reductive and substantially insoluble in water. Appropriate examples thereof include: metal powder having reducing power such as reductive iron, reductive zinc, or reductive tin powder; a lower metal oxide such as FeO or $Fe_3O_4$; and a reductive metal compound containing as a main component one or two or more kinds of iron carbide, ferrosilicon, iron carbonyl, and iron hydroxide in combination. An example of a particularly preferred oxygen absorber is reductive iron such as reductive iron obtained by reducing iron oxide obtained in a production process of steel, pulverizing produced sponge iron, and conducting finish reduction in a hydrogen gas or a decomposed ammonia gas. Another example thereof is reductive iron obtained by electrolytically depositing iron from an aqueous solution of iron chloride obtained in a pickling step during steel production, pulverizing the resultant, and conducting finish reduction.

As required, the oxygen absorber may be used in combination with: an oxidation accelerator formed of an electrolyte such as a hydroxide, carbonate, sulfite, thiosulfate, tribasic phosphate, dibasic phosphate, organic acid salt, or halide of an alkali metal or alkali earth metal; and an assistant such as active carbon, active alumina, or active clay. Particularly preferred examples of the oxygen accelerator include sodium chloride, calcium chloride, and a combination thereof.

In the case where reductive iron and the oxidation accelerator are used in combination, a mixing amount thereof is preferably 99 to 80 parts by weight of reductive iron and 1 to 20 parts by weight of oxidation accelerator, in particular, 98 to 90 parts by weight of reductive iron and 2 to 10 parts by weight of oxidation accelerator with respect to 100 parts by weight in total.

Another example of the oxygen absorber is a polymer compound having a polyhydric phenol in a skeleton such as a phenol/aldehyde resin having a polyhydric phenol. Further, ascorbic acid, erysorbic acid, tocophenols, and salts thereof which are water-soluble substances may appropriately be used. Of oxygen absorbable substances, reductive iron and an ascorbic acid-based compound are particularly preferred.

Further, a thermoplastic resin may contain the resin having oxygen absorbing property itself as an oxygen absorber.

The oxygen absorber preferably has an average particle size of generally 50 μm or less, and particularly preferably 30 μm or less. In the case where the packaging container requires transparency or translucency, an oxygen absorber having an average particle size of preferably 10 μm or less, and particularly preferably 5 μm or less is used. The oxygen absorber is preferably mixed into the resin in a ratio of preferably 1 to 70 wt %, and particularly preferably 5 to 30 wt %.

In the present invention, as the material constituting the container body and the lid, a laminate having a multi-layer structure including various barrier films and an oxygen absorbing resin layer is preferably used. An adhesive layer may be optionally interposed between layers constituting the laminate. The adhesive is not particularly limited and is, for example, a polyolefin-based adhesive modified by an acid anhydride such as maleic anhydride, polyurethane-based adhesive or an adhesive which is used as an adhesive for laminates.

The preferred layer structure of the laminate constituting the container body includes: polypropylene (PP), an adhesive, a gas barrier resin such as a saponified product of an ethylene-vinyl acetate copolymer (EVOH), an adhesive, and PP; and PP, an adhesive, EVOH, an adhesive, oxygen absorbing resin layer (for example, polyolefin containing reducing iron and an oxidation accelerator), and PP; in the order from the exterior side of the container.

The preferred layer structure of the laminate constituting the lid includes: nylon (NY), EVOH, and PP/polyethylene (PE)-based composite material; NY, EVOH, and linear low-density polyethylene (LLDPE); vapor deposited polyethylene terephthalate (PET), NY, and PP/PE-based composite material; vapor deposited PET, NY, and LLDPE; and vapor deposited PET, NY, and polybutylene terephthalate (PBT)-based resin; from the exterior side of the lid.

Next, the packaging container for a microwave oven of the present invention will be described more with reference to the drawings.

Figure 2:
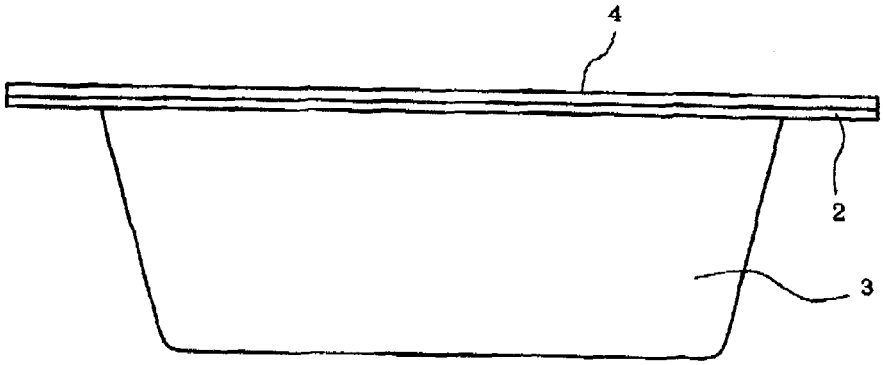
FIG. 2 A front view of the packaging container for a microwave oven shown in FIG. 1.
Figure 3:
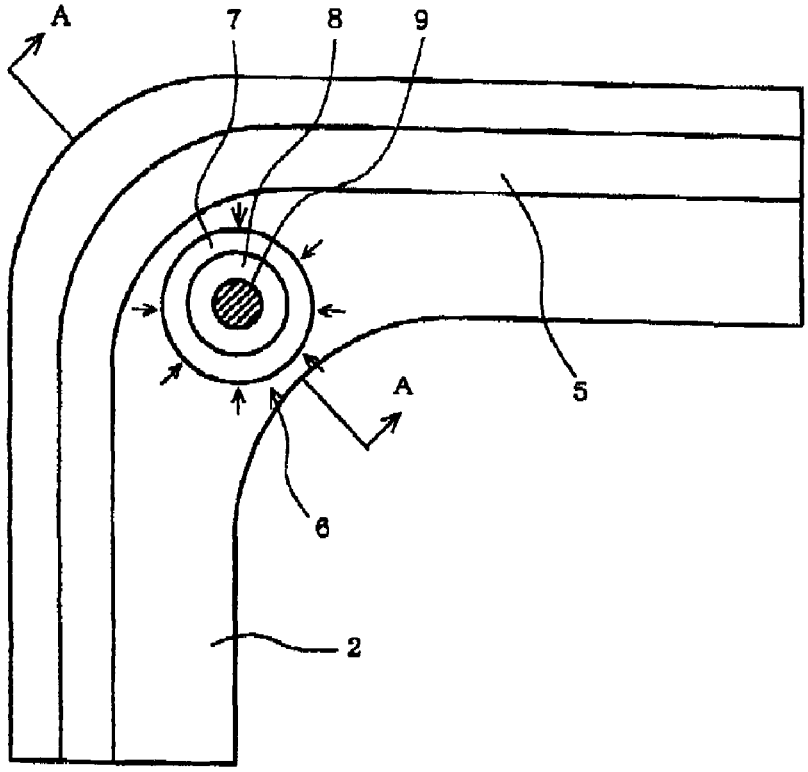
FIG. 3 A partially enlarged view of a steam releasing seal part of the packaging container for a microwave oven shown in FIG. 1.
Figure 4:
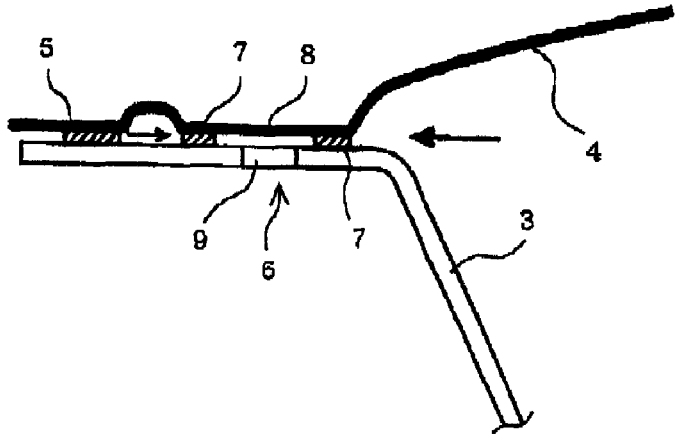
FIG. 4 A view showing a state of a cross-section during heating, taken along an A-A line shown in FIG. 3.

FIGS. 1 to 4 are schematic views showing an example of the packaging container for a microwave oven of the present invention. FIG. 1 is a plan view of the container, and FIG. 2 is a front view of the container. Further, FIG. 3 is a partially enlarged view of a steam releasing seal part of the container, and FIG. 4 is a view showing a state of a cross-section taken along a line A-A in FIG. 3.

A packaging container 1 for a microwave oven comprises a container body 3 having a flange part 2 and a lid 4, and the container body 3 is filled with contents (not shown) such as sterile rice, retort food, or frozen food, and thereafter, the lid 4 is heat-sealed to the periphery of the flange part 2 to seal the container hermetically. On an inner side of a peripheral seal part 5 of the flange part 2 in a corner portion of the container, a steam releasing seal part 6 is provided at a position separate from the peripheral seal part 5. The steam releasing seal part 6 comprises an outer seal part 7 obtained by heat-sealing the flange part 2 and the lid 4 in an annular shape, a buffer part 8 made of an unsealed part provided in the outer seal part 7, and a weakened part 9 made of a through-hole formed in the flange part 2 in the buffer part 8. Further, in another corner portion of the container, the peripheral seal part 5 is formed to be narrow slightly so as to project in an angular shape in an outside direction of the container to provide a sealed part 10 for opening.

When the packaging container 1 for a microwave oven is heated by a microwave oven, the internal pressure of the container increases due to the water vapor or the like generated from the contents contained in the container, and the lid 4 expands outward (see FIG. 4). Then, in the steam releasing seal part 6 provided in the corner portion, as represented by arrows in FIGS. 3 and 4, stress is applied from the outer peripheral portion of the outer seal part 7 to the outer seal part 7, whereby the outer seal part 7 starts peeling. When the internal pressure of the container increases further and the peeling of the outer seal part 7 reaches the buffer part 8 made of the unsealed part, the water vapor blows out downward from the weakened part 9 made of the through-hole provided in the flange part 2, and the internal pressure of the container decreases, whereby heating/cooking of the contents is completed.

After that, the container 1 is taken out from the microwave oven, and the container 1 is opened from the sealed part 10 for opening provided in another corner portion, and the contents are eaten. In order to facilitate opening of the lid, a tag projecting outside of the sealed part 10 for opening may be provided on the lid 4.

In the packaging container 1, the steam releasing seal part 6 is provided at a position separate from the peripheral seal part 5 inside the peripheral seal part 5 of the flange part 2, whereby the stress generated due to the increase in an internal pressure in the container is applied to the outer peripheral part of the outer seal part 7 of the steam releasing seal part 6 during heating by a microwave oven. Consequently, the peeling of the outer seal part 7 is performed smoothly and exactly. Thus, before the steam releasing seal part 6 opens, the lid 4 can be prevented from peeling from the peripheral seal part 5, and the container 1 can be prevented from exploding. Then, the container body 3 can be prevented from being deformed without being supplied with excess stress, so that the present invention is preferable since the container is used as a dish as it is after heating/cooking, and the contents are eaten.

Further, the peeling of the outer seal part 7 starts, and the internal pressure of the container 1 is maintained until the peeling reaches the buffer part 8. Therefore, the taste of the contents is enhanced through a steaming effect, and the heating/cooking time by a microwave oven can be shortened. In addition, the buffer part 8 made of the unsealed part is provided in the outer seal part 7 of the steam releasing seal part 6, and the weakened part 9 made of the through-hole is formed in the flange part in the buffer part 8, whereby it becomes easy to position the weakened part 9 in the steam releasing seal part 6, and the operation efficiency in the steps of filling and sealing the contents can be enhanced. Further, the steam releasing seal area is selected without being influenced by the size of a through-hole, a plurality of through-holes are formed depending upon the kind of the contents, etc., whereby the range of design of the steam releasing seal part is enlarged. Further, since water vapor blows out downward from the flange part 2 at a time of opening of the steam releasing seal part 6, an accident such as the burning of a user due to water vapor can be prevented.

Figure 5:
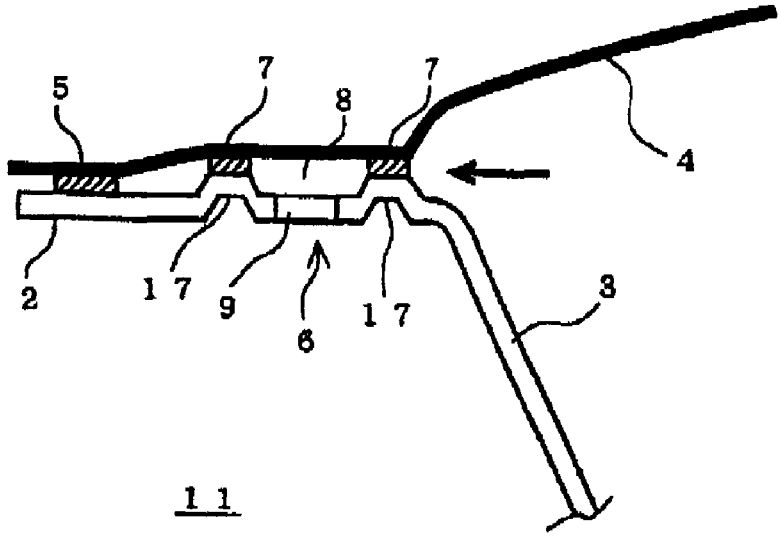
FIG. 5 A partial cross-sectional view showing another example of the packaging container for a microwave oven of the present invention.

FIG. 5 is a view showing another example of the packaging container for a microwave oven of the present invention, and shows a state of a cross-section in the vicinity of a steam releasing seal part when the container is heated by a microwave oven in the same way as in FIG. 4.

In the packaging container 11, an annular convex part 17 is provided at a position corresponding to the outer seal part 7 of the flange part 2 of the container body 3, and the flange part 2 and the lid 4 are heat-sealed at the convex part 17, whereby the outer seal part 7 of the steam releasing seal part 6 is formed.

Figure 13:
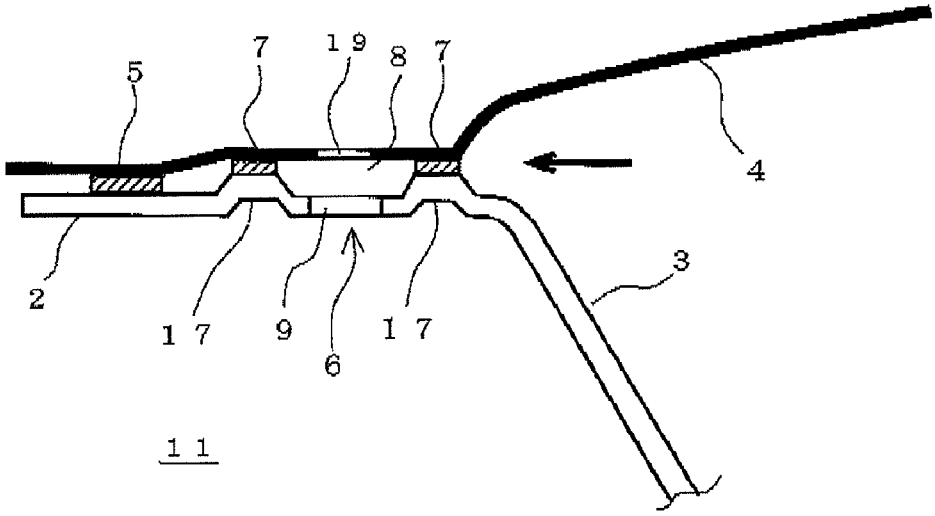
FIG. 13 A partial cross sectional view showing yet another example of the packaging container for a microwave oven of the present invention.

The other constitutions of the packaging container 11 are the same as those of the packaging container 1 shown in FIGS. 1 to 4, and the buffer part 8 made of an unsealed part is provided in the outer seal part 7, and the weakened part 9 made of a through-hole is provided in the flange part 2 in the buffer part 8. In addition, as shown in FIG. 13, the weakened part 19 made of a through-hole is provided in the lid 4 in the buffer part 8. Further, the flat peripheral part of the flange part 2 is heat-sealed to the lid 4 along the entire periphery, whereby the peripheral seal part 5 separate from the steam releasing seal part 6 is formed.

In the packaging container 11, when the container body 3 is molded, the annual convex part 17 can be formed in the flange part, and simultaneously, a through-hole can be formed inside thereof. When the convex part 17 is heat-sealed, the convex part 17 is pressed by heating with a flat sealing plate having a diameter larger than the outer diameter of the convex part 17, whereby the outer seal part 7 can be formed without requiring positioning.

Figure 6:
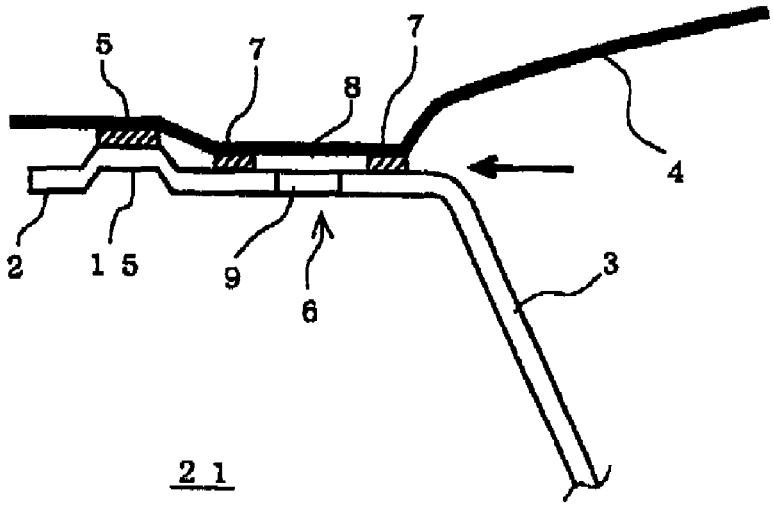
FIG. 6 A partial cross-sectional view showing another example of the packaging container for a microwave oven of the present invention.

FIG. 6 is a view showing another example of the packaging container for a microwave oven of the present invention, and shows a state of a cross-section in the vicinity of a steam releasing seal part when the container is heated by a microwave oven in the same way as in FIG. 4.

In the packaging container 21, the convex part 15 is provided along the entire outer peripheral part of the flange part 2 of the container body 3, and the flange part 2 and the lid 4 are heat-sealed at the convex part 15, whereby the peripheral seal part 5 is formed.

The other constitutions of the packaging container 21 are the same as those of the packaging container 1 shown in FIGS. 1 to 4. In the flat part inside the peripheral seal part 5 in the corner portion, the outer seal part 7 in which the flange part 2 and the lid 4 are heat-sealed in an annular shape, the buffer part 8 made of the unsealed part provided in the outer seal part 7, and the weakened part 9 made of a through-hole in the flange part 2 in the buffer part 8 are formed at a position separate from the peripheral seal part 5, whereby the steam releasing seal part 6 is formed.

In the packaging container 21, in the same way as in the packaging container 11 shown in FIG. 5, it is preferred that the convex part 15 and a through-hole to be the weakened part 9 of the steam releasing seal part 6 be formed simultaneously in the flange part when the container body 3 is molded.

Figure 7:
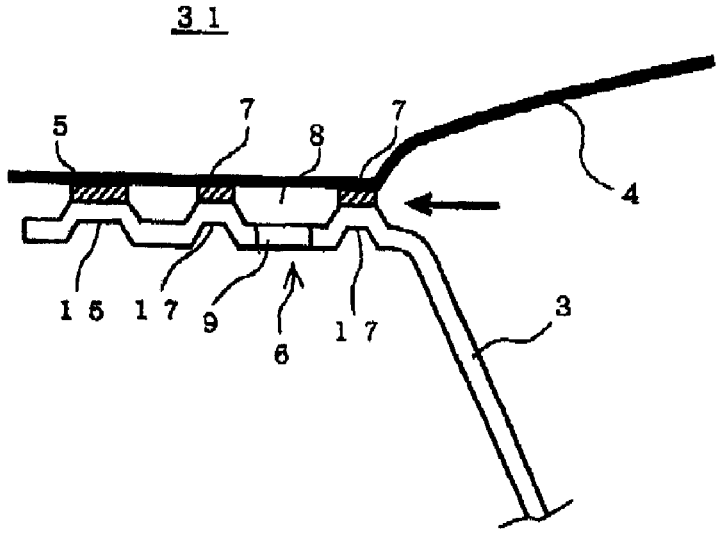
FIG. 7 A partial cross-sectional view showing another example of the packaging container for a microwave oven of the present invention.

FIG. 7 is a view showing another example of the packaging container for a microwave oven of the present invention, and shows a state of a cross-section in the vicinity of a steam releasing seal part when the container is heated by a microwave oven in the same way as in FIG. 4.

In the packaging container 31, an annular convex part 17 is provided at a position corresponding to the outer seal part 7 of the flange part 2 of the container body 3, and the flange part 2 and the lid 4 are heat-sealed at the convex part 17, whereby the outer seal part 7 of the steam releasing seal part 6 is formed.

Further, in the same way as in the packaging container 21 in FIG. 6, the convex part 15 is provided along the entire outer peripheral part of the flange part 2 of the container body 3, and the flange part 2 and the lid 4 are heat-sealed at the convex part 15, whereby the peripheral seal part 5 is formed.

In the packaging container 31, it is preferred that the convex part 15 and the annular convex part 17 be formed in the flange part, and simultaneously, a through-hole to be the weakened part 9 be formed inside the annular convex part 17.

Figure 8:
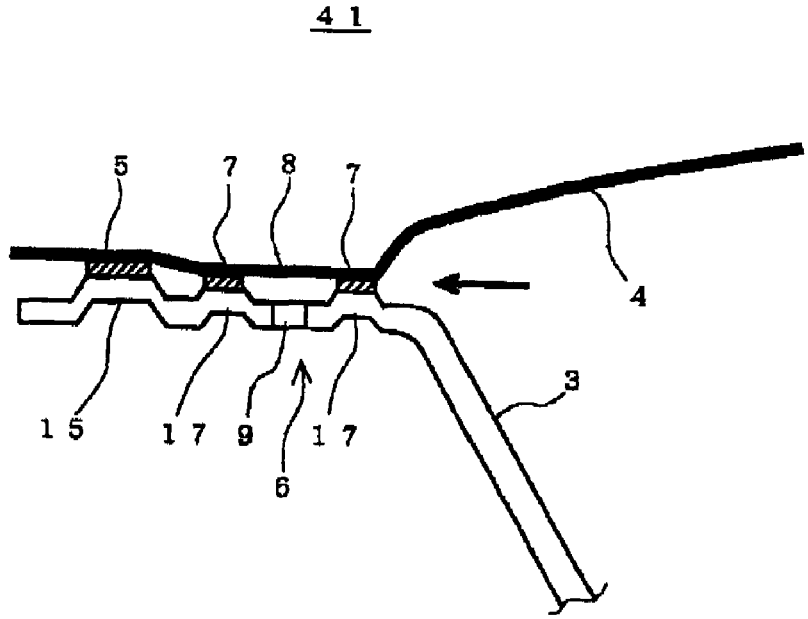
FIG. 8 A partial cross-sectional view showing another example of the packaging container for a microwave oven of the present invention.

FIG. 8 is a view showing another example of the packaging container for a microwave oven of the present invention, and shows a state of a cross-section in the vicinity of a steam releasing seal part when the container is heated by a microwave oven in the same way as in FIG. 4.

In the packaging container 41, in order to form the peripheral seal part 5 in the packaging container 31 shown in FIG. 7, the height of the convex part 15 provided along the entire outer peripheral part of the flange part 2 of the container body 3 is set to be larger than that of the convex part 17 provided so as to form the outer seal part 7 of the steam releasing seal part 6. The other constitutions of the packaging container 41 are the same as those of the packaging container 31 shown in FIG. 7.

Figure 9:
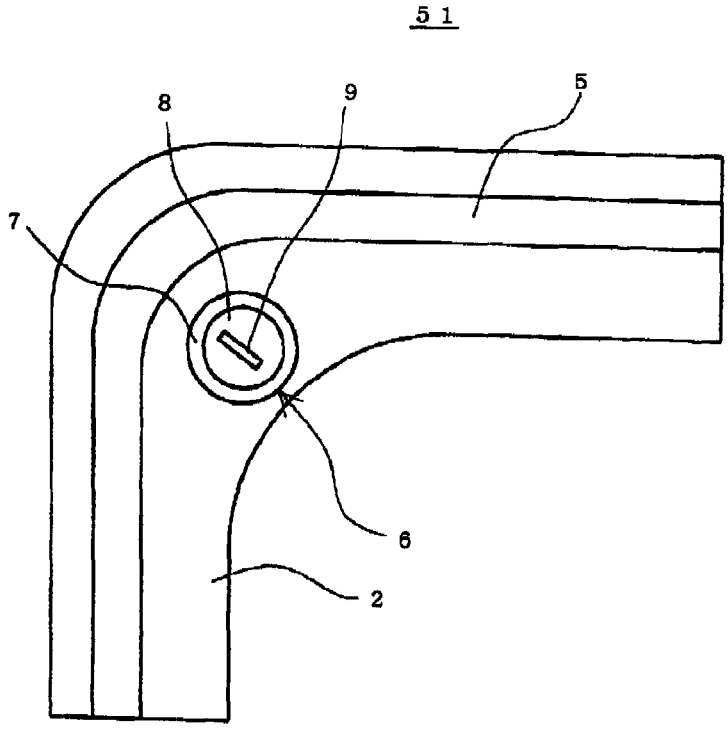
FIG. 9 A partially enlarged view of a steam releasing seal part showing another example of the packaging container for a microwave oven of the present invention.

FIG. 9 is a view showing another example of the packaging container for a microwave oven of the present invention, which is an partially enlarged view of the steam releasing seal part of the container.

In the packaging container 51, a slit-shaped through-hole is provided in the flange part 2 in the buffer part 8 of the steam releasing seal part 6, whereby the weakened part 9 is formed in the packaging container 1 shown in FIGS. 1 to 4. The other constitutions of the packaging container 51 are the same as those of the packaging container 1 shown in FIGS. 1 to 4.

Figure 10:
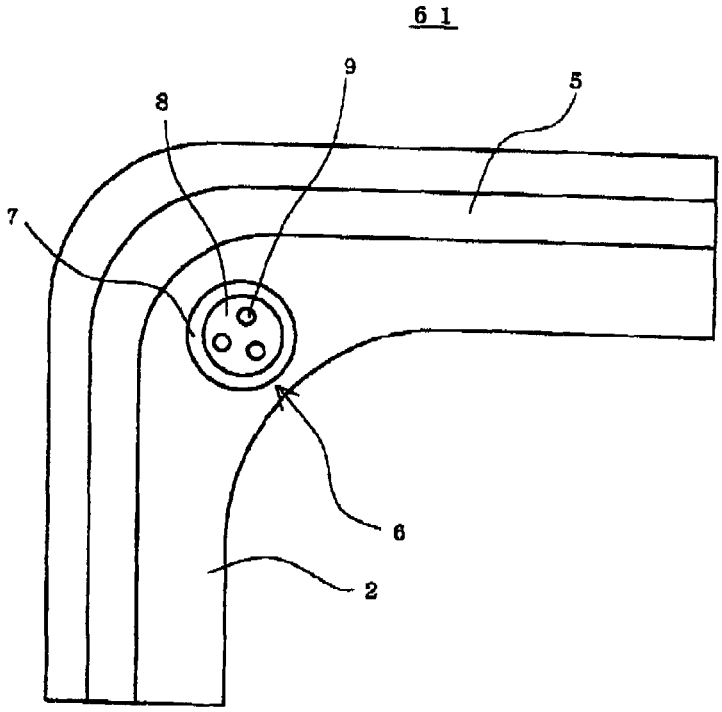
FIG. 10 A partially enlarged view of the steam releasing seal part showing another example of the packaging container for a microwave oven of the present invention.

FIG. 10 is a view showing another example of the packaging container for a microwave oven of the present invention, which is an partially enlarged view of the steam releasing seal part of the container.

In the packaging container 61, three through-holes are provided in the flange part 2 in the buffer part 8 of the steam releasing seal part 6, whereby the weakened part 9 is formed in the packaging container 1 shown in FIGS. 1 to 4. The other constitutions of the packaging container 61 are the same as those of the packaging container 1 shown in FIGS. 1 to 4.

In each of the above examples, a packaging container which has a square shape and in which one steam releasing seal part is provide in the corner portion has been described. However, needless to say, the shape of the packaging container can be appropriately modified. For example, the shape of the packaging container is modified to a cylindrical shape, etc., and at least two steam releasing seal parts are provided, etc.

Further, the weakened part of the steam releasing seal part may be formed by providing a through-hole in the lid instead of the flange part, or by providing through holes both in the flange part and the lid.

The packaging container body and the lid can be manufactured by a common method. For example, as a forming method of the container body, vacuum forming, pressure forming, vacuum pressure forming, or injection molding may be used. It is needless to say that the size of the packaging container may be set arbitrarily.

Next, a process for manufacturing the packaging container for a microwave oven of the present invention by processing a plastic sheet will be described. In the following example, a procedure of manufacturing the packaging container 11 in which the annular convex part 17 is provided at a position corresponding to the outer seal part 7 of the steam releasing seal part 6 shown in FIG. 5 from a plastic multi-layered sheet will be described with reference to the drawings.

Figure 11:
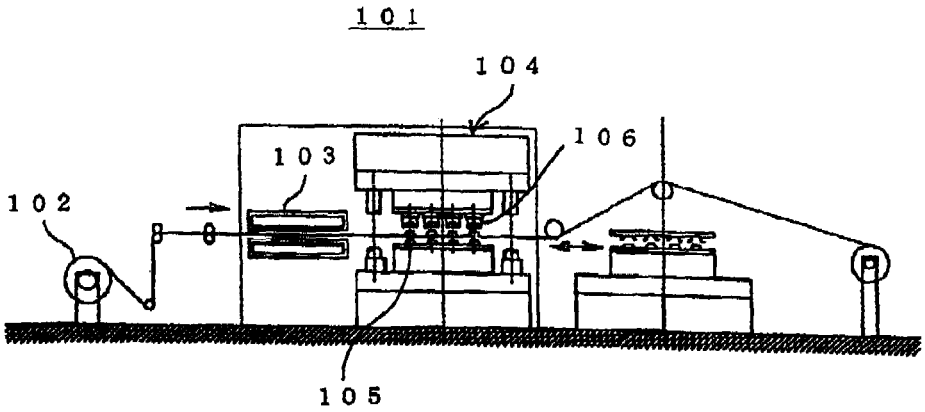
FIG. 11 A view showing an apparatus used in improved process for manufacturing packaging container for a microwave oven of the present invention.
Figure 12:
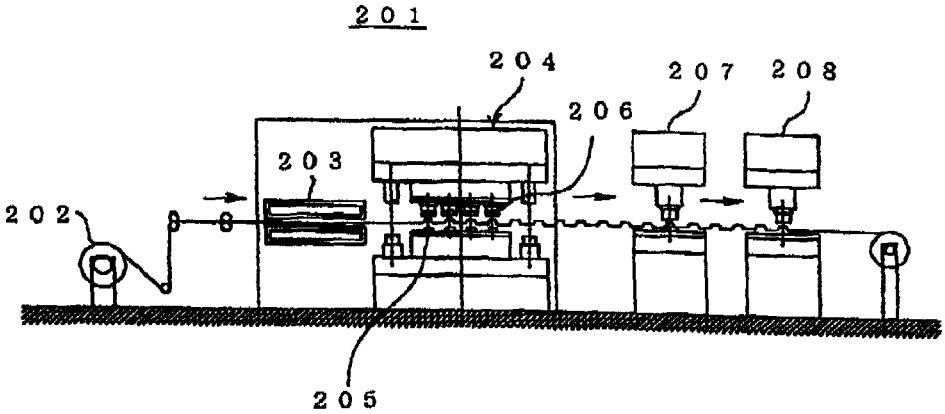
FIG. 12 A view showing an apparatus used in a conventional process for manufacturing a packaging container.

FIG. 11 is a schematic view showing the apparatus 101 used for an improved process for manufacturing a packaging container for a microwave oven of the present invention. Further, FIG. 12 is a schematic view showing the apparatus 201 used in a conventional process for manufacturing a packaging container.

In this example, a multi-layered sheet is previously manufactured by extrusion molding, and thereafter, a rolled multi-layered sheet 102 is attached to a pressure/vacuum forming machine 101 shown in FIG. 11 to be unwound. Then, the sheet is softened or melted by a heater 103 and sent to a forming station 104. The heated sheet is pushed into a die 106 with a plug 105, and the die 106 is closed. After that, the sheet is brought into contact with the die 106 by vacuum or air pressure to be cool-solidified, thereby manufacturing a container 11 shown in FIG. 5.

When the die 106 is closed, the heated sheet is sandwiched with a pressure tool from above and below to form a part of a flange of the container 11 into an annular step shape, whereby the convex part 17 corresponding to the outer seal part 7 of the steam releasing seal part 6 is formed. Simultaneously, a steam releasing hole 9 is opened in the vicinity of the center of the stepped part with a punch incorporated in the pressure tool. Further, while the container is being cooled, the flange outer peripheral part is trimmed off with a band-shaped blade tool incorporated into the position facing the die to cut the container 11 from the sheet, and the container 11 is transported by another apparatus.

When the container body is processed from the plastic multi-layered sheet, only the processing of the steam releasing hole 9 and the trimming of the flange outer peripheral part may be performed simultaneously without forming an annular step in the step of forming as in the container 1 shown in FIGS. 1 to 4. Only the formation of the convex part and the processing of the steam releasing hole by the formation of an annular step may be performed simultaneously in the step of forming a container, and the flange outer peripheral part may be trimmed off in another step.

The packaging container for a microwave oven is manufactured by the above-mentioned process, whereby the displacement between the convex part 17 corresponding to the outer seal part 7 of the steam releasing seal part 6, the steam releasing hole 9, and the container outer peripheral part can be minimized. Consequently, the container is filled with contents and the lid is heat-sealed hermetically, and thereafter, the steam releasing seal part 6 opens smoothly at heating/cooking by a microwave oven, whereby steam is released.

According to the conventional process for manufacturing a container, as shown in FIG. 12, the punching by the punch 207 and the trimming of the flange outer peripheral part by a trimming apparatus 208 are performed separately after the container is formed in a forming station 204. At this time, each of the containers has a different pitch due to the difference in a shrinking state of the plastic sheet during the formation of the container, and the position of the steam releasing hole 9 varies, with a result that a sealing defect, abnormal releasing of steam, and the like occur. The container outer peripheral size also varies, so that the seal position varies when the container is filled with contents and sealed, and similar trouble may occur.

According to the improved process for manufacturing a container of the present invention, the above-mentioned problems of prior art are solved, and a packaging container for a microwave oven can be obtained, in which the displacement of the steam releasing seal part 6 provided in the flange part is eliminated to prevent seal leakage, and the steam releasing seal part 6 opens spontaneously and stably at heating/cooking by a microwave oven.

EXAMPLES

The following examples are provided for the purpose of further illustrating the packaging container for a microwave oven of the present invention, but the present invention is not limited to the examples.

Example 1

A multi-layered sheet with a total thickness of 0.9 mm was manufactured by ordinary co-extrusion molding with a 3-kind and 5-layer constitution including: in the stated order from the outer layer, a polypropylene resin outer layer (thickness: 400 μm) with a titanium white pigment added to polypropylene having a melt index (MI) of 0.5; an adhesive layer (thickness: 20 μm) made of maleic anhydride modified polypropylene; a barrier layer (thickness: 60 μm) made of an ethylene-vinyl alcohol copolymer; the same adhesive layer as the above (thickness: 20 μm); and a polypropylene resin inner layer with MI=0.5 (thickness: 400 μm).

Using the multi-layered sheet, a square container (flange width: 8 mm in a linear portion, 17 mm of maximum width in a corner portion) with a flange having the shape shown in FIG. 5 with a container outer size of 156 mm×133 mm and a height of 29 mm (inner capacity: about 340 ml) was formed by an ordinary vacuum/pressure forming machine. In the flange part 2 in the corner portion of the container, the annular convex part 17 with an outer diameter of 8 mm, an inner diameter of 4 mm, and a height of 0.5 mm to be the outer seal part 7 of the steam releasing seal part 6 was formed into a step by a pressure tool during formation of the container. Simultaneously, a through-hole with a diameter of 2 mm to be a weakened part 9 was also formed at the center of the steam releasing seal part 6 by a punch.

On the other hand, a laminate constituting a lid was formed by dry lamination in the following procedure, using a biaxially oriented polyester film (outer layer) with a thickness of 12 μm, a biaxially oriented nylon film (intermediate layer) with a thickness of 15 μm, and a polypropylene-based film (inner layer) made of an ethylene/propylene-based complex material with a thickness of 50 μm, with a polyurethane-based adhesive placed between the respective resin layers.

First, an adhesive was applied to an outer layer material with a gravure roll or the like, and a solvent was evaporated and dried in a dry oven at a temperature of 80 to 100° C. An adhesive layer in an adhesive state and an intermediate layer material were attached, and crimped by heated metal roll and rubber roll, and thereafter, the resultant is passed through a cooling metal roll to be wound up. In a similar procedure, the inner layer material was attached to the laminate and cut into a desired size to constitute a lid 4.

Using a sterile packaging filling line, the above-mentioned container was filled with 200 g of sterile rice, and thereafter, the lid 4 was heat-sealed to the flange part 2 of the container to seal hermetically, whereby the peripheral seal part 5 with a seal width of 3 mm and the steam releasing seal part 6 separated from the peripheral seal part 5 was formed. The steam releasing seal part 6 has the buffer part 8 made of an unsealed part with a diameter of 4 mm and the weakened part 9 made of a through-hole with a diameter of 2 mm provided at the center of the flange part in the buffer part 8, inside the annular outer seal part 7 with an outer diameter of 8 mm and a seal width of 2 mm.

Further, as shown in FIG. 1, in another corner portion, the peripheral seal part 5 is set to be slightly narrow to provide an angular portion projecting outward of the container, whereby the sealed part 10 for opening was formed.

Example 2

The packaging container shown in FIG. 1 was manufactured in the same way as in Example 1, except that the steam releasing seal part 6 was formed in the flat flange part 2 without forming the annular convex part 17 to be the outer seal part 7 of the steam releasing seal part 6 in the flange part 2 in the corner portion of the container, and the packaging container was filled with 200 g of sterile rice and sealed hermetically in the same way.

Comparative Example 1

A packaging container was manufactured in the same way as in Example 2, except that the steam releasing seal part was not provided in Example 2, and the packaging container was filled with 200 g of sterile rice and sealed hermetically in the same way.

Table 1 shows the results obtained by heating/cooking each set of 10 packaging containers filled with sterile rice and sealed hermetically obtained in the above respective examples in a 600 w microwave oven. Table 1 also shows the number of damaged packaging containers obtained by dropping each set of 10 packaging containers in an inverted manner from the height of 80 cm at 5° C. and checking the presence/absence of damages.

Regarding these containers, the seal strength (average value) measured from inside of the container of the peripheral seal part 5 was 10.5 N/15 mm in any of the containers, and the opening strength (average value) measured from outside of the sealed part 10 for opening was 15.0 N/cup in any of the containers.

TABLE 1

| | Heating test by microwave oven | | Drop test |
|---|---|---|---|
| | Steam releasing position and state | Container deformation | Number of damages |
| Example 1 | Steam released from steam releasing seal part smoothly in all containers | Small | 0 |
| Example 2 | Steam released from steam releasing seal part smoothly in all containers | Small | 0 |
| Comparative Example 1 | Steam released explosively from bow, linear part, corner R part, etc. | Large | 0 |

As shown in Table 1, in the packaging container with a steam releasing seal part of the present invention, the steam releasing seal part retracts gradually with the increase in an internal pressure by heating with a microwave oven, whereby steam was released very smoothly and exactly. At this time, the deformation of a container was suppressed to be small. Further, even in the drop test, the sealed part was not damaged.

Particularly, in the packaging container of Example 1 in which the steam releasing seal part was formed into a step, because there was no displacement between the steam releasing seal part and the steam releasing hole, steam was released very stably. Further, it was found that there was little danger when a steam releasing hole is placed in the flange part of the container because steam is released downward from the container.

Further, compared with a conventional product that is heated by a microwave oven after a lid is peeled, the sealing performance can be maintained until the steam is released, so that the taste of rice is enhanced through a steaming effect.

On the other hand, in the packaging container of Comparative Example 1, in which the steam releasing seal part is not provided, steam is released from various positions by heating with a microwave oven, so that steam blows out explosively due to a large peeling area, and a steaming effect is decreased.

Example 3

A multi-layered sheet with a total thickness of 0.8 mm was manufactured by ordinary co-extrusion molding with a 4-kind and 5-layer constitution including: in the stated order from the outer layer, a polypropylene resin outer layer (thickness: 350 μm) with a titanium white pigment added to polypropylene having a melt index (MI) of 0.5; an adhesive layer (thickness: 20 μm) made of maleic anhydride modified polypropylene; a barrier layer (thickness: 60 μm) made of an ethylene-vinyl alcohol copolymer; the same adhesive layer as the above (thickness: 20 μm); and a polypropylene resin inner layer with MI=0.5 (thickness: 350 μm).

Using the multi-layered sheet, a square container (flange width: 8 mm in a linear portion, 17 mm of maximum width in a corner portion) with a flange having the shape shown in FIG. 5 with a container outer size of 156 mm×133 mm and a height of 29 mm (inner capacity: about 340 ml) was formed by an ordinary vacuum/pressure forming machine shown in FIG. 11.

In the flange part 2 in the corner portion of the container, the annular convex part 17 with an outer diameter of 8 mm, an inner diameter of 4 mm, and a height of 0.2 mm to be the outer seal part 7 of the steam releasing seal part 6 was formed into a step by a pressure tool, and simultaneously, the steam releasing hole 9 with a diameter of 2.5 mm was formed at the center of the annular convex part 17 by a punch. Further, simultaneously, the flange outer peripheral part was trimmed with a band-shaped blade tool.

On the other hand, a laminate constituting a lid was formed by dry lamination in the following procedure, using a biaxially oriented polyester film (outer layer) with a thickness of 12 μM, a biaxially oriented nylon film (intermediate layer) with a thickness of 15 μm, and a polypropylene-based film (inner layer) made of an ethylene/propylene-based complex material with a thickness of 50 μm, with a polyurethane-based adhesive placed between the respective resin layers.

First, an adhesive was applied to an outer layer material with a gravure roll or the like, and a solvent was evaporated and dried in a dry oven at a temperature of 80 to 100° C. An adhesive layer in an adhesive state and an intermediate layer material were attached, and crimped by heated metal roll and rubber roll, and thereafter, the resultant is passed through a cooling metal roll to be wound up. In a similar procedure, the inner layer material was attached to the laminate and cut into a desired size to constitute a lid 4.

Using a sterile packaging filling line, the above-mentioned container was filled with 200 g of sterile rice, and thereafter, the lid 4 was heat-sealed to the flange part 2 of the container to seal hermetically, whereby the peripheral seal part 5 with a seal width of 2 mm and the steam releasing seal part 6 separated from the peripheral seal part 5 was formed. The steam releasing seal part 6 has the weakened part 9 made of a through-hole with a diameter of 2.5 mm provided at the center of the flange part in the buffer part 8 made of an unsealed part with a diameter of 4 mm, inside the annular outer seal part 7 with an outer diameter of 8 mm and a seal width of 2 mm.

Further, as shown in FIG. 1, in another corner portion, the peripheral seal part 5 is set to be slightly narrow to provide an angular portion projecting outward of the container, whereby the sealed part 10 for opening was formed.

Example 4

In Example 3, a square container with a flange having the shape shown in FIGS. 1 to 4 was formed, in which the steam releasing seal part 6 was formed as the flat flange part 2, without forming the annular convex part 17 to be the outer seal part 7 of the steam releasing seal part 6 in the flange part 2 in the corner portion of the container.

In the same way as in Example 3, a packaging container was manufactured and filled with 200 g of sterile rice and sealed hermetically similarly.

Reference Example

A packaging container shown in FIGS. 1 to 4 was manufactured in the same way as in Example 4, except that the formation of the steam releasing hole 9 with a diameter of 2.5 mm at the center of the steam releasing seal part 6 and the trimming of the flange outer peripheral part by a band-shaped blade tool were performed separately in Example 4, and filled with 200 g of sterile rice and sealed hermetically similarly.

Table 2 shows the results obtained by heating/cooking each set of 10 packaging containers filled with sterile rice and sealed hermetically obtained in Examples 3 and 4 and Reference Example in a 600 w microwave oven. Table 2 also shows the number of damaged packaging containers obtained by dropping each set of 20 packaging containers in an inverted manner from the height of 80 cm at 5° C. and checking the presence/absence of damages.

Regarding these containers, the seal strength (average value) measured from inside of the container of the peripheral seal part 5 was 12 N/15 mm in any of the containers, and the opening strength (average value) measured from outside of the sealed part 10 for opening was 17 N/cup in any of the containers.

TABLE 2

| | Heating test by microwave oven | | | | |
|---|---|---|---|---|---|
| | Steam releasing position and state | | | | |
| | Steam releasing seal part | Parts other than steam releasing seal part | Steam releasing state | Container de-formation | Drop test Number of damages |
| Example 3 | 10 | 0 | Steam released smoothly | Small | 0 |
| Example 4 | 10 | 0 | Steam released smoothly | Small | 0 |
| Reference Example 1 | 10 | 1 | Steam released from steam releasing hole and a separate place simultaneously | Small | 0 |

As shown in Table 2, in the packaging container of the present invention, obtained by forming the steam releasing hole and trimming the container outer peripheral part simultaneously, the steam releasing seal part retracted gradually with the increase in an internal pressure by heating with a microwave oven, whereby the steam was released very smoothly and exactly. At this time, the deformation of the container was suppressed to be small. Further, the sealed part was not damaged even in the drop test.

Particularly, in the packaging container of Example 3 in which the steam releasing seal part was formed into a step, because there is no displacement between the steam releasing seal part and the steam releasing hole, the steam was released very stably.

Further, compared with a conventional product that is heated by a microwave oven after a lid is peeled, the sealing performance can be maintained until the steam was released, so that the taste of rice was enhanced through a steaming effect.

On the other hand, in the case of the packaging container of Reference Example in which each of the formation of the convex part by forming an annular step, the formation of the steam releasing hole, and the trimming of the container outer peripheral part was performed separately, the displacement between the steam hole and the seal was large in some cases, and the steam was released from the steam releasing hole by heating with a microwave oven and simultaneously, the steam was also released from the positions other than the steam releasing hole in some cases. No damages were found in the drop test.

The invention claimed is:

1. A process for manufacturing a packaging container for a microwave oven which is hermetically sealed by heat-sealing a lid to a periphery of a flange part of a container body made of a synthetic resin, comprising at least one steam releasing seal part having a weakened part inside a peripheral seal part of the flange part at a position separated from the peripheral seal part, wherein the steam releasing seal part is provided in the flange part and comprises an outer seal part, a buffer part adjacent to the outer seal part, and a weakened part made of a through-hole formed in the flange part of the buffer part, and wherein a convex part is provided at a position corresponding to the outer seal part of the steam releasing seal part of the flange part, and the outer seal part of the steam releasing seal part is formed by heat-sealing the convex part to the lid, said process comprising:

forming a convex part and a through-hole as a weakened part both provided in a flange part simultaneously, when a packaging container body is manufactured by processing a plastic sheet.

2. A process for manufacturing a packaging container for a microwave oven which is hermetically sealed by heat-sealing a lid to a periphery of a flange part of a container body made of a synthetic resin, comprising at least one steam releasing seal part having a weakened part inside a peripheral seal part of the flange part at a position separated from the peripheral seal part, wherein the steam releasing seal part is provided in the flange part and comprises an outer seal part, a buffer part adjacent to the outer seal part, and a weakened part made of a through-hole formed in the flange part of the buffer part, and wherein a convex part is provided at a position corresponding to the outer seal part of the steam releasing seal part of the flange part, and the outer seal part of the steam releasing seal part is formed by heat-sealing the convex part to the lid, said process comprising:

trimming a flange outer peripheral part from a plastic sheet and forming a convex part and a through-hole as a weakened part both provided in a flange part simultaneously, when a packaging container body is manufactured by processing the plastic sheet.

3. A process for manufacturing a packaging container for a microwave oven which is hermetically sealed by heat-sealing a lid to a periphery of a flange part of a container body made of a synthetic resin, comprising at least one steam releasing seal part having a weakened part inside a peripheral seal part of the flange part at a position separated from the peripheral seal part, wherein the steam releasing seal part is provided in the flange part and comprises an outer seal part, a buffer part adjacent to the outer seal part, and a weakened part made of a through-hole formed in the flange part of the buffer part, said process comprising:

trimming a flange outer peripheral part from a plastic sheet and forming a through-hole as a weakened part in a flange part simultaneously, when a packaging container body is manufactured by processing the plastic sheet.

4. A packaging container for a microwave oven which is hermetically sealed by heat-sealing a lid to a periphery of a flange part of a container body made of a synthetic resin, comprising at least one steam releasing seal part having a weakened part inside a peripheral seal part of the flange part at a position separated from the peripheral seal part;

wherein the stem releasing seal part is provided in the flange part and comprises an outer seal part, a buffer part adjacent to the outer seal part, and a weakened part made of a through-hole formed in the flange part of the buffer part;

wherein a convex part is provided along an entire outer peripheral part of the flange part, and the lid is heat-sealed to the convex part to form a peripheral seal part; and wherein a height of the convex part is higher than that of the outer seal part of the steam releasing seal part.

* * * * *